United States Patent [19]

Odajima

[11] Patent Number: 4,828,168

[45] Date of Patent: May 9, 1989

[54] METHOD OF CONTROLLING DUCT-TYPE AIR CONDITIONING SYSTEM

[75] Inventor: Chuya Odajima, Konan, Japan

[73] Assignee: Diesel Kiki Co., Ltd., Tokyo, Japan

[21] Appl. No.: 178,346

[22] Filed: Apr. 6, 1988

[30] Foreign Application Priority Data

Apr. 8, 1987 [JP] Japan ..... 62-86134

[51] Int. Cl.[4] ..... F24F 7/00

[52] U.S. Cl. ..... 236/49.5; 98/31.6; 165/22

[58] Field of Search ..... 236/49 D; 165/22; 98/31.5, 31.6

[56] References Cited

U.S. PATENT DOCUMENTS

| | | | |
|---|---|---|---|
| 2,266,986 | 12/1941 | Murphy | 165/22 |
| 4,086,781 | 5/1978 | Brady et al. | 98/1.5 |
| 4,754,919 | 7/1988 | Orsuka et al. | 236/49 D |

*Primary Examiner*—William E. Wayner

*Attorney, Agent, or Firm*—Wenderoth, Lind & Ponack

[57] ABSTRACT

A method of controlling a centralized or duct-type air conditioning system wherein the speed of a blower, the open area of an intake shutter and the open area of each of grille shutters are regulated in a predetermined control pattern which is selected in accordance with a desired level set by a temperature setter for each individual room.

5 Claims, 1 Drawing Sheet

METHOD OF CONTROLLING DUCT-TYPE AIR CONDITIONING SYSTEM

BACKGROUND OF THE INVENTION

1. Field of the Invention

This invention relates to a method of controlling a centralized or duct-type air conditioning system including a single indoor unit for supplying the controlled air through duct to a plurality of rooms in a building.

2. Description of the Prior Art

Various centralized or duct-type air conditioning systems are known in which the conditioned air is supplied from a single indoor unit through ducts to individual rooms to keep the temperature and humidity in the rooms at comfort values. In one such known system disclosed in Japanese Patent Laid-open Publication No. 61-91425, there are provided two ducts one of which is used for the passage of the cool air to be supplied to the respective rooms, the other duct being used for the passage of the recirculated air returning from the rooms. Alternately, in the heating mode, the last-mentioned duct is used for the passage of the warm air to be blown off into the rooms while the first-mentioned duct is used for the passage of the recirculated air returning from the rooms. The capacity of the disclosed air conditioning system is controlled by control shutters or dampers which are disposed at supply air grilles of the respective rooms and which are manually or electrically moved between a fully opened position and a fully closed position through a half-closed position.

The prior duct-type air conditioning system has no capacity controller other than the aforesaid control dampers. Consequently, since a fan is driven at a constant speed, as the number of empty room (i.e. closed damper) increases, so the internal pressure of the duct increases which will increase the amount of supply air per unit time. Thus, the regulation of air conditioning capacity for one room affects the air conditioning capacity for another room with the result that a stable air conditioning is difficult to obtain. The foregoing drawback may be overcome by releasing part of the internal pressure to another duct, thereby maintaining the duct internal pressure in a controlled condition against undue elevation. Such attempt however result in a waste in the capacity of the fan. Heretofore, a satisfactory method of controlling the centralized or duct-type air conditioning system has not been proposed.

SUMMARY OF THE INVENTION

With the foregoing drawbacks in view, it is an object of the present invention to provide a method of controlling a centralized or duct-type air conditioning system, which method enables the air conditioning system to be operated at a proper air conditioning capacity for a desired level set by a temperature setter.

According to the invention, the foregoing and other objects are attained by a method of controlling a duct-type air conditioning system including an indoor unit having a heat exchanger for producing cool air or warm air, a blower and an intake shutter, and a duct assembly having a plurality of supply grilles through which the cool air or warm air is supplied to the corresponding number of rooms, the supply grilles being provided with respective grill shutters, said method comprising the steps of:

setting a temperature setter of each respective room at a desired level; and selecting a predetermined control pattern to determine a speed of rotation of the blower, an open area of the intake shutter and an open area of each of the grille shutters in accordance with the set desired level, thereby enabling the air conditioning system to operate under controlled condition in the selected control pattern.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A certain preferred embodiment of the present invention will be described below in greater detail with reference to the accompanying drawings.

Figure 1:
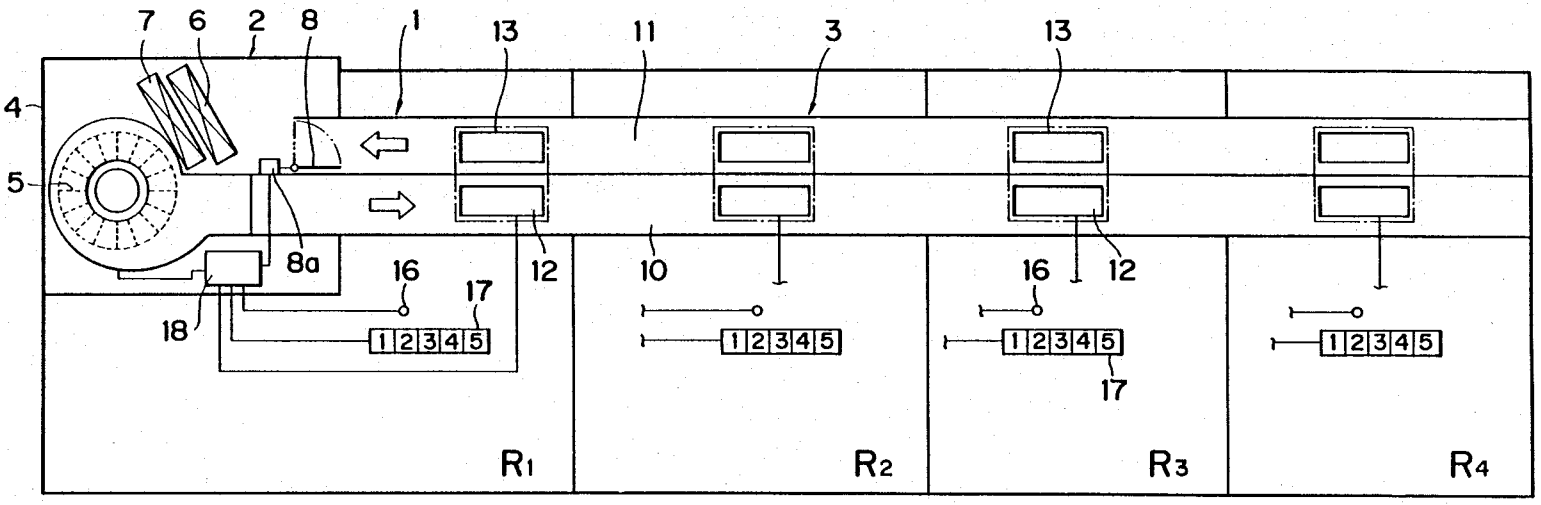
FIG. 1 is a diagrammatical view showing the general construction of a centralized or duct-type air conditioning system according to the present invention.

FIG. 1 shows a centralized or duct-type air conditioning system 1 installed in a building for conditioning air in a plurality of rooms R1 through R4 (four in the illustrated embodiment) in the building.

The duct-type air conditioning system 1 is composed of an indoor unit 2 having at least a blower, and a duct assembly 3 extending from the indoor unit 2 to the respective rooms R1–R4.

The indoor unit 2 includes a casing 4, a blower 5 and two heat exchangers 6, 7 disposed in the casing 4. The heat exchanger 6 comprises an evaporator constituting a part of a refrigeration cycle or system for cooling air. On the other hand, the heat exchanger 7 is composed of a heater through which a hot water is circulated to heat air as the latter flows across the heater 7. The indoor unit 2 further includes an intake shutter 8 for throttling the recirculated air returning from the rooms R1–R4. An actuator **8*a* is operatively connected to the intake shutter 8** for regulating the open area of the latter.

Figure 2:
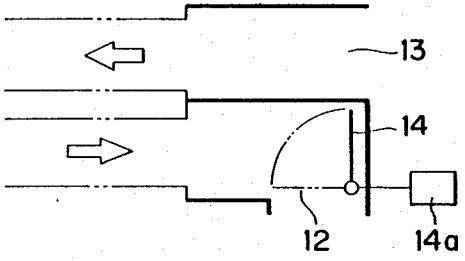
FIG. 2 is a diagrammatical view showing a supply grille and a discharge grille in detail.

The duct assembly 2 is disposed in the ceilings of the respective rooms R1–R4 and is composed of a supply duct 10 through which the controlled air fed from the indoor unit 2 is supplied to the respective rooms R1–R4, and a discharge duct 11 through which the recirculated air from the rooms R1–R4 is returned to the indoor unit 2. The duct assembly 3 has supply grilles 12 and discharge grilles 13 which are disposed in the positions corresponding to the positions of the respective rooms R1–R4. Thus, the controlled air is blown off into the rooms R1–R4 from the corresponding supply grilles 12 and, after circulation in the rooms, it is forced to flow from the discharge grilles 13 into the discharge duct 11. As shown in FIG. 2, at least the supply grilles 12 are provided with grille shutters 14 for controlling the supply of controlled air into the respective rooms R1–R4.

Each of the grille shutters 14 is operatively connected with an actuator **14*a* for regulating the open area of the grille shutter 14** to control the supply of controlled air.

In each of the rooms R1–R4, there are disposed a temperature sensor 16 for detecting the temperature of the respective room, and a temperature setter 17 for setting a desired temperature. When the temperature setter 17 is actuated, the blower 5 and the heat exchangers 6, 7 are started and the speed of rotation of the blower 5, the open areas of the intake and grille shutters 8, 14 are regulated in accordance with a predetermined program stored in a microcomputer or the like control unit 18. In the illustrated embodiment, the blower speed and the open area of the intake and grille shutters 8, 14 are used as control factors based on which the temperature control of the respective rooms R1–R4 is undertaken.

The operation of the air conditioning system of the foregoing construction is controlled in accordance with the control patterns shown in the following Table.

TABLE

| Grille Shutter | Intake Shutter | Blower Speed | Desired Level | Control Pattern | Number of Room |
|---|---|---|---|---|---|
| F/O | F/O | H | 5 | [5] | 1 |
| F/O | F/O | M | 4 | [4] | |
| F/O | F/O | L | 3 | [3] | |
| F/O | T | L | 2 | [2] | |
| T | T | L | 1 | [1] | |
| F/O | F/O | H | ≧8 | [5] | 2 |
| F/O | F/O | M | 7–6 | [4] | |
| F/O | F/O | L | 5–4 | [3] | |
| F/O | T | L | ≦3 | [2] | |
| F/O | F/O | H | ≧9 | [5] | 3 |
| F/O | F/O | M | 8–6 | [4] | |
| F/O | F/O | L | ≦5 | [3] | |
| F/O | F/O | H | ≧7 | [5] | 4 |
| F/O | F/O | M | ≦6 | [4] | |

As appears clear from the Table, the control patterns are so determined as to set the blower speed, the open area of the intake shutter and the open area of each of the grille shutters at proper values corresponding to desired levels set by the temperature setters 17.

For instance, if the number of room to be air-conditioned is one and the desired temperature set by the temperature setter is level "5" (there are established five levels "1"–"5" to be set with level "5" as the maximum), then control pattern [5] is selected from a total of five patterns [1]–[5]. The selected pattern is the maximum level in which the blower 5 is driven at a high speed (H), both the intake and grille shutters 8, 14 are fully opened (F/O).

In case the desired temperature is set at level "4", then control pattern [4] is selected to thereby drive the blower at a medium speed (M) and also to hold the intake and grille shutters 8, 14 in their fully opened positions (F/O).

When the desired level is set at the value "3", then the control pattern is set at the value [3] in which the blower is driven to rotate at a low speed (L) and the intake and grille shutters 8, 14 are fully opened (F/O).

Likewise, if the desired temperature is set at the level "2", then control pattern [2] is selected in which instance the blower is driven at the low speed (L), the intake shutter 8 is held in its throttled position (T), and the grille shutter 14 is held in its fully opened position.

When the desired level is set at the value "1", then the control pattern [1] is selected in which the blower is driven at the low speed (L) and the intake and grille shutters 8, 14 are held in throttled positions, respectively.

As described above, the desired levels "1"–"5" set by the temperature setter correspond to the selected control patterns [1]–[5], respectively, when only one room is to be air-conditioned. When two or more rooms are to be air-conditioned, the control pattern is set at a value which is determined by the sum of desired levels set by the temperature setters for the respective rooms. For instance, if the number of room to be air-conditioned is two and the sum of set desired levels is "more than 8", then the control pattern [5] is selected. Likewise, the levels "7–6", "5–4" and "less than 3" correspond respectively to the control patterns [4], [3] and [2].

In case the number of room to be air-conditioned is three, the control patterns [5], [4] and [3] are set respectively in response to the setting of desired levels "more than 9", "8–6" and "less than 5".

Likewise, when four rooms are to be air-conditioned, the set desired levels "more than 7" and "less than 6" will choose the control patterns [5] and [4], respectively.

As described above, the control pattern is selected depending on the desired level set by the respective temperature setters 17. In accordance with the control pattern thus selected, the operation of the duct-type air conditioning system is controlled until the temperature of each of the rooms becomes equal to the preset value.

Obviously, various modifications and variations of the present invention are possible in the light of the above teaching. It is therefore to be understood that within the scope of the appended claims the invention may be practiced otherwise than as specifically described.

What is claimed is:

1. A method of controlling a duct-type air conditioning system including an indoor unit having a heat exchanger for producing cool air or warm air, a blower and an intake shutter, and a duct assembly having a plurality of supply grilles through which the cool air or warm air is supplied to the corresponding number of rooms, the supply grilles being provided with respective grill shutters, said method comprising the steps of:

(a) setting a temperature setter of each respective room at a desired level; and (b) selecting a predetermined control pattern to determine a speed of rotation of the blower, an open area of the intake shutter and an open area of each of the grille shutters in accordance with the set desired level, thereby enabling the air conditioning system to operate under controlled condition in the selected control pattern.

2. A method according to claim 1, wherein the number of set temperature setter is plural, and said control pattern is determined by the sum of desired levels of the thus set temperature setters.

3. A method according to claim 1, wherein said speed of the blower is selectable between at least two levels.

4. A method according to claim 1, wherein said open area of the intake shutter is selectable between at least two levels corresponding respectively to a fully opened position and an predetermined position between said fully opened position and a fully closed position.

5. A method according to claim 1, wherein said open area of each of said grille shutters is selectable between a fully opened position and a predetermined position between said fully opened position and a fully closed position.

* * * * *